US010286290B2

(12) United States Patent
Nichols

(10) Patent No.: US 10,286,290 B2
(45) Date of Patent: May 14, 2019

(54) CARD CADDY DEVICE

(71) Applicant: Chris Nichols, Swanton, MD (US)

(72) Inventor: Chris Nichols, Swanton, MD (US)

(73) Assignee: Chris Nichols, Swanton, MD (US)

( * ) Notice: Subject to any disclaimer, the term of this patent is extended or adjusted under 35 U.S.C. 154(b) by 493 days.

(21) Appl. No.: 14/827,369

(22) Filed: Aug. 17, 2015

(65) Prior Publication Data

US 2017/0050106 A1 Feb. 23, 2017

(51) Int. Cl.
*A63F 1/06* (2006.01)
*A63F 9/04* (2006.01)

(52) U.S. Cl.
CPC ..... *A63F 1/062* (2013.01); *A63F 9/0495* (2013.01); *A63F 2250/481* (2013.01); *A63F 2250/482* (2013.01)

(58) Field of Classification Search
CPC ..... A63F 1/062; A63F 1/10; A63F 9/0495; A63F 2250/481; A63F 2250/482
USPC ..... 206/425; 273/148 A
See application file for complete search history.

(56) References Cited

U.S. PATENT DOCUMENTS

| | | | | | |
|---|---|---|---|---|---|
| 1,320,798 | A * | 11/1919 | Salambo | A63F 1/06 | 235/90 |
| 2,607,594 | A * | 8/1952 | Rubinoff | A63F 1/10 | 206/449 |
| 2,705,555 | A * | 4/1955 | Brenner | A63F 1/12 | 206/216 |
| 2,731,270 | A * | 1/1956 | Milton | A63F 1/10 | 206/449 |
| 2008/0128987 | A1* | 6/2008 | LaPorte | A63F 1/06 | 273/148 A |
| 2015/0251079 | A1* | 9/2015 | Wright | A63F 1/10 | 273/148 A |

* cited by examiner

*Primary Examiner* — Steven A. Reynolds

(57) ABSTRACT

The present invention provides a versatile card caddy device comprised of two or more identical structures, or card caddy units, configured to provide a playing card case which can be converted easily into one or more discard trays. The present invention further provides a storage box adjoined to a closed card caddy for storing, carrying and transporting dice, tokens, score pads, pens, pencils and other accessories associated with card playing. The card caddy device allows for cost-effective manufacturing because only one mold is required to manufacture the single card caddy unit; secure closure in the closed configuration due to a bump and dimple closure mechanism; viewing of a deck of cards inside the closed card caddy due to a circular opening in the card caddy unit, which also provides assistance in opening the closed card caddy; and easier pick up of the a card in a stack of cards due to a slightly raised grid pattern on the bottom end of the rectangular base of the card caddy unit.

10 Claims, 8 Drawing Sheets

CARD CADDY DEVICE

FIELD OF THE INVENTION

The present invention relates to containers for games and, in particular, to a convertible, versatile container device for playing card games as well as for storing and transporting cards.

BACKGROUND OF THE INVENTION

Playing cards have been used for games, gambling, education, advertising, fortune telling, political messages and other uses for hundreds of years. Decks of cards typically are stored and transported in paper boxes, bound by rubber bands, or in specially manufactured hard cases usually made of metal or wood. These methods serve to both protect the deck of cards to keep the cards together. However, paper boxes and rubber bands easily deteriorate, and hard cases often are expensive and bulky.

Once a deck of cards have been transported to a playing location, most card games require stacking of piles of discarded or sorted cards. Stacks of cards are susceptible to being knocked or blown over, which impacts play of the game. Discard trays made of a variety of materials are available to assist in the management of card piles during play, but they too usually are bulky and non-portable.

There exists a need, therefore, for a playing card container which overcomes the shortcomings of the prior art. Currently, no single product exists which can function both as a playing card case and a discard tray, can allow users to safely transport one or more deck of cards and then play a game anywhere, and is compact, portable, easily manufactured and cost-effective.

SUMMARY OF THE INVENTION

The present invention fulfills this need by providing a versatile card caddy device that is compact, portable, easily manufactured and cost-effective. The card caddy device of the invention is comprised of two or more identical structures, or card caddy units, configured to function as a playing card case which can be converted easily into one or more discard trays, which allow users to safely store and transport one or more decks of cards and then play a card game anywhere.

In particular, the present invention provides a card caddy device comprising two or more identical card caddy units. Each card caddy unit is comprised of a rectangular base having a bottom surface, a top surface, a first end, a second end, a first side, a second side, a first slot wall, a second slot wall and a tab wall. Each of the slot walls has an inner side and an outer side and is comprised of a short arm and a long arm which are perpendicular to each other. The slot walls are perpendicular to the rectangular base. The long arm of the first slot wall is located on the first end of the rectangular base, the short arm of the first slot wall is located on the first side of the rectangular base, the long arm of the second slot wall is located on the second end of the rectangular base, and the short arm of the second slot wall is located on the first side of the rectangular base. The ends of the short arms of the slot walls have a space there between defining an opening. A slot is located at the end of each of the short arms of the slot walls. A bump and a dimple are spaced apart and located vertically from one another on the end of each of the long arms of the slot walls. The tab wall has an inner side and an outer side, and is located centrally on the second side of the rectangular base and perpendicular thereto. A circular opening is located in the rectangular base, and includes one or more bumps located on the periphery of the opening, one or more indentations adjacent to the opening, and a peripheral shoulder configured to receive a circular object therein. The one or more bumps secure the circular object in the opening, and the one or more indentations allow for easy removal of the circular object.

The card caddy device of the invention is configured so that a first card caddy unit fits into a second card caddy unit to provide either a closed card caddy for storing or transporting playing card, or an open discard tray for use while playing a card game.

The closed card caddy is provided by aligning the inner side of one card caddy unit atop the inner side of the other card caddy unit, and fitting the tab wall of each of the card caddy units into the slots of the other card caddy unit. The circular opening allows for easy opening of the closed card caddy by placing fingers into the opening and pulling each card caddy unit gently apart.

The discard tray, which has partially enclosed areas for holding two or more separate piles of cards as well as openings to allow for easy access to playing cards, is provided by aligning the second side of one card caddy unit next to the first side of the other card caddy unit, and fitting the tab wall of one card caddy unit into the slots of the other card caddy unit.

The present invention further provides a storage box for attachment to the closed card caddy for storing, carrying and transporting dice, tokens, score pads, pens, pencils and other accessories associated with card playing. In particular, the storage box comprises a rectangular container having a base and four walls projecting upwardly from and perpendicular to the base, the walls defining an interior opening therein. The walls have at their upper end a flange thereon, wherein a bump is located at each of four corners of the flange. The container is configured to snap onto a closed card caddy by placing the rectangular flange of the container into the rectangular depression of one card caddy unit, with the dimples of the card caddy unit snapping into the bumps of the flange in order to secure the closed card caddy onto the container.

BRIEF DESCRIPTION OF THE DRAWINGS

A fuller understanding of the invention can be gained from the following description when read in conjunction with the accompanying figures, where like reference numerals refer to identical or functionally similar elements throughout the separate views, which illustrate some, but not the only and exclusive, examples of embodiments of the invention and, as such, the figures disclosed herein are to be considered illustrative rather than limiting. In the drawings.

DETAILED DESCRIPTION OF THE INVENTION

As used herein, the term "card caddy device" is defined as a convertible device comprised of two identical card caddy units for carrying, storing or transporting a deck of cards; or two or more card caddy units for use as a playing card discard tray.

As used herein, the term "card caddy" is interchangeable with "card deck boxes" and "card deck containers."

As used herein, the terms "card caddy" and "closed card caddy" are interchangeable, both terms meaning two card caddy units attached to one another in a closed configuration to provide a closed card caddy container.

As used herein, the term "discard tray" is meant to refer to two or more card caddy units attached to one another in an open configuration to provide an open container for use when playing a card game with a deck of cards, in which the discarded cards are placed from one part of the open container into one or more other parts of the open container.

As used herein, "bump" is defined as a small, substantially round, elevation.

As used herein, "dimple" is defined as a small, substantially round, indentation.

Figure 1A:
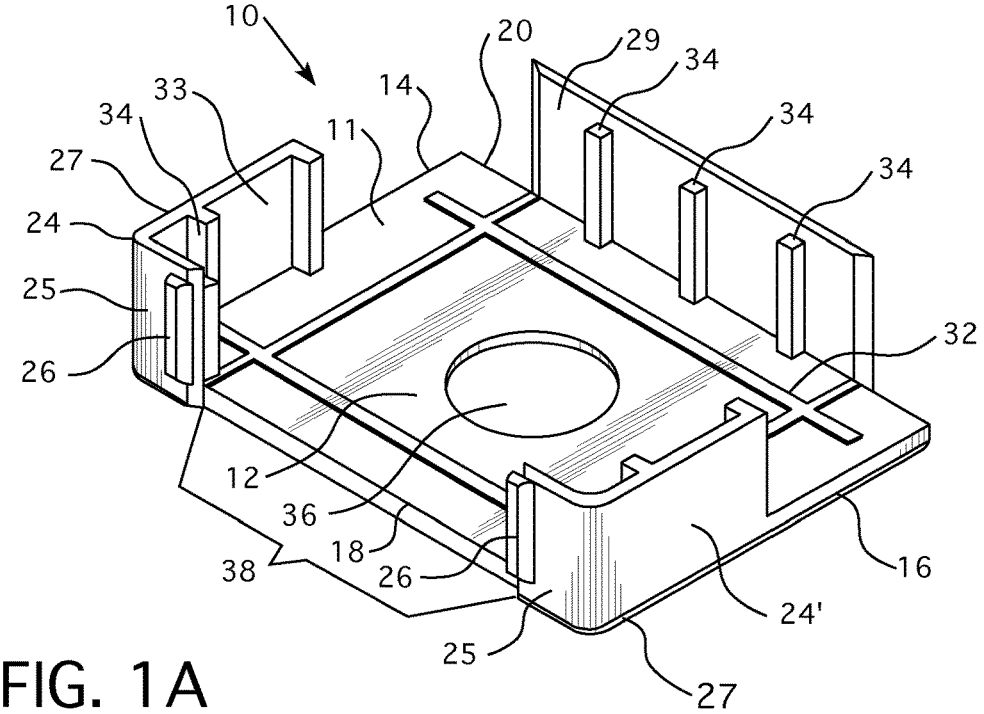
FIGS. 1A and 1B are two perspective views of a card caddy unit, in accordance with an embodiment of the present invention.
Figure 1B:
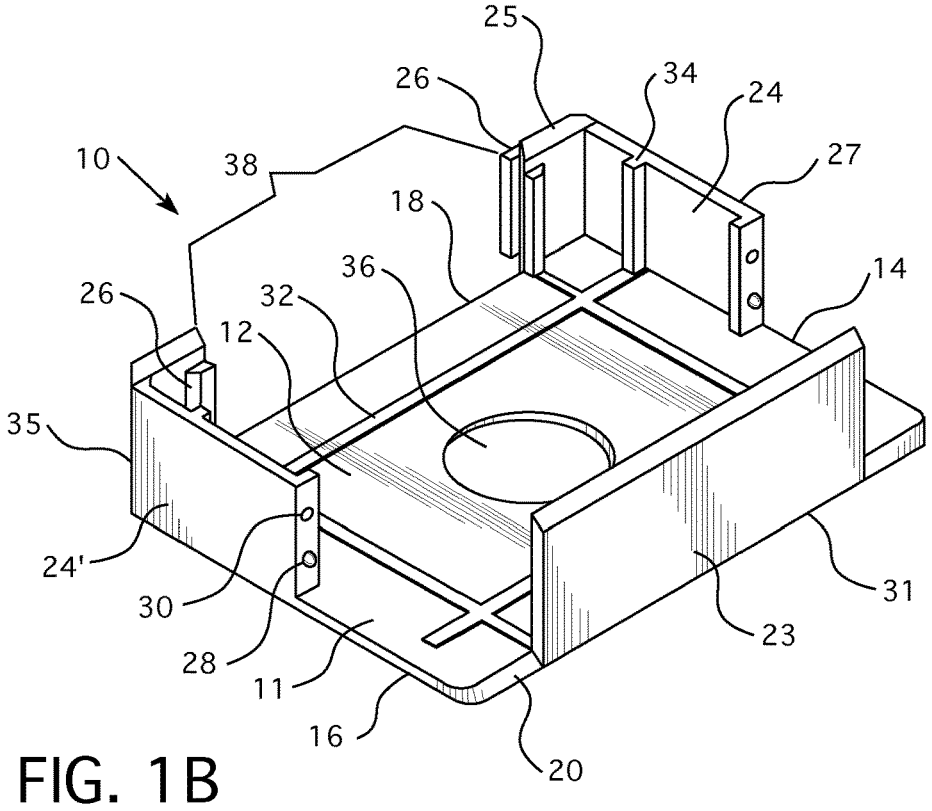
Figure 2A:
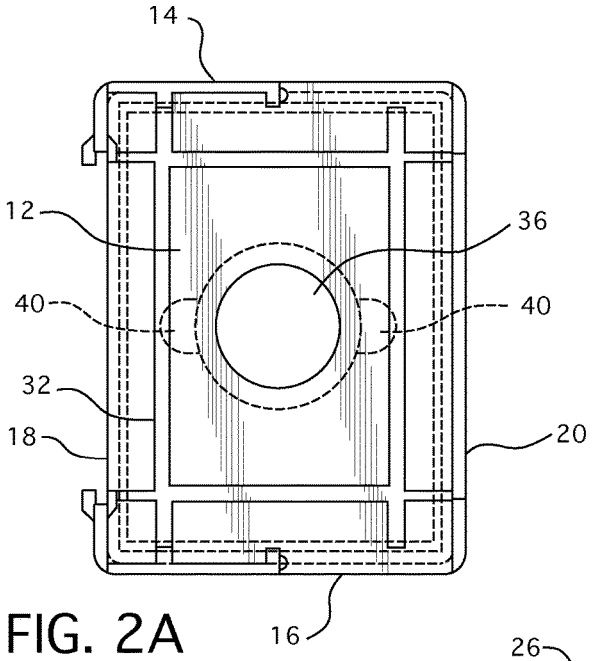
FIGS. 2A, 2B and 2C are top plan views of a card caddy unit, in which 2A is a plan view of the bottom surface of the card caddy unit; 2B is a plan view of the top surface of the card caddy unit; and 2C is a plan view of one end of the card caddy unit showing a long arm of a slot wall and an opening between the slot wall and a tab wall, in accordance with an embodiment of the present invention.
Figure 2C:
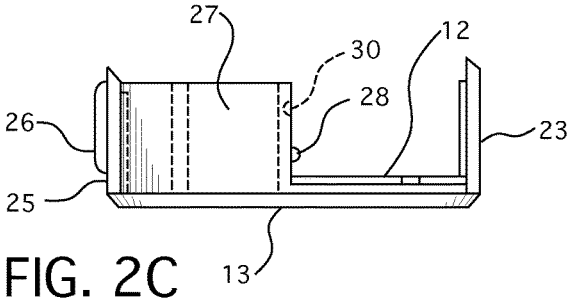
Figure 2B:
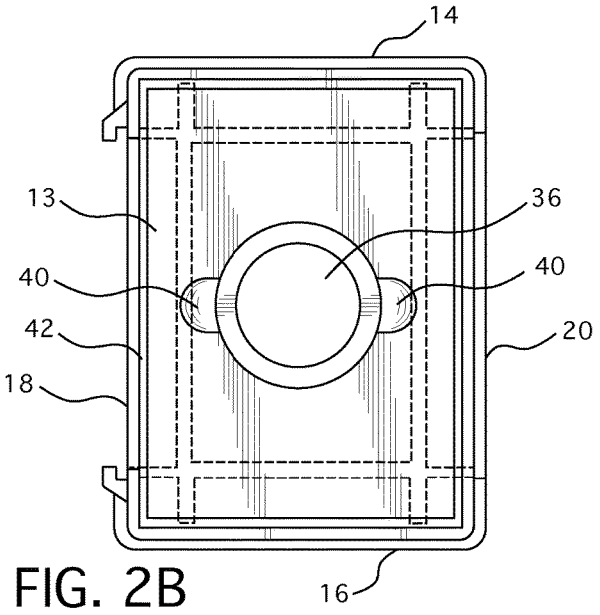
Figure 3:
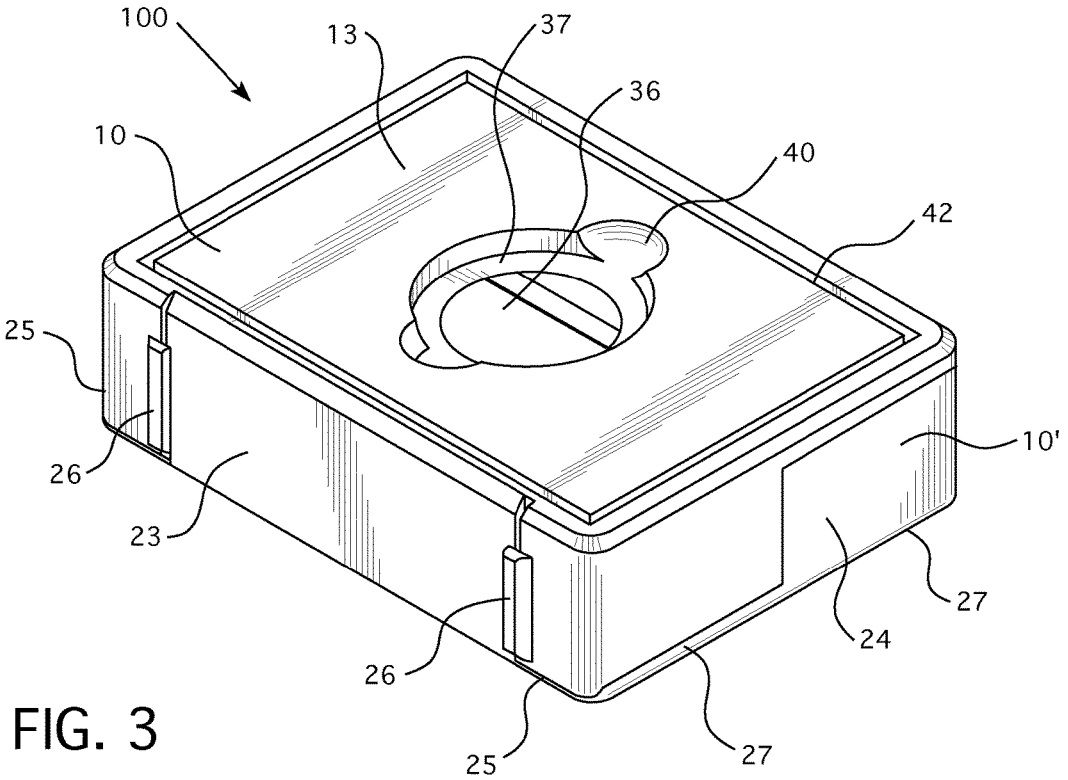
FIG. 3 is a perspective view of a card caddy in a closed configuration, in accordance with an embodiment of the present invention.
Figure 4A:
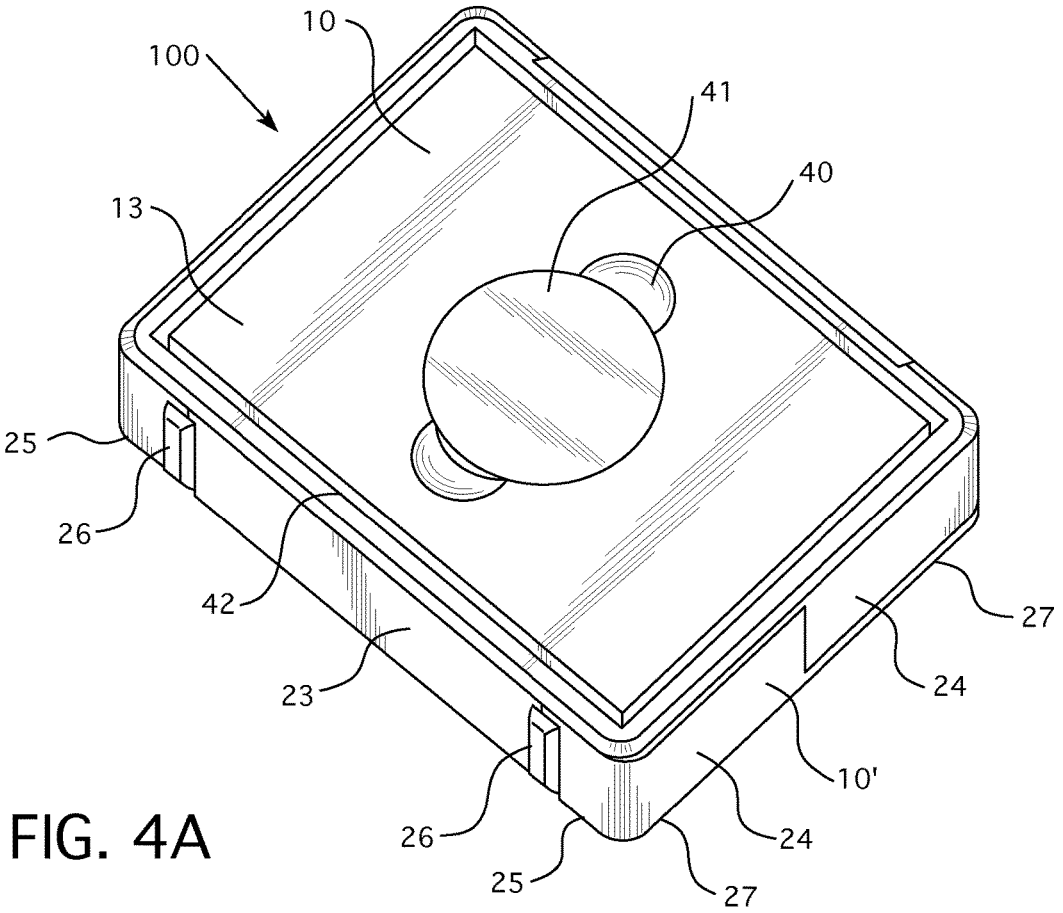
FIGS. 4A and 4B is a perspective view and a partial view, respectively, of the top surface of a card caddy, in which 4A shows a token or coin inserted in the central opening of the card caddy unit; and 4B shows the top surface of the card caddy in which two bumps are visible, in accordance with an embodiment of the present invention.
Figure 4B:
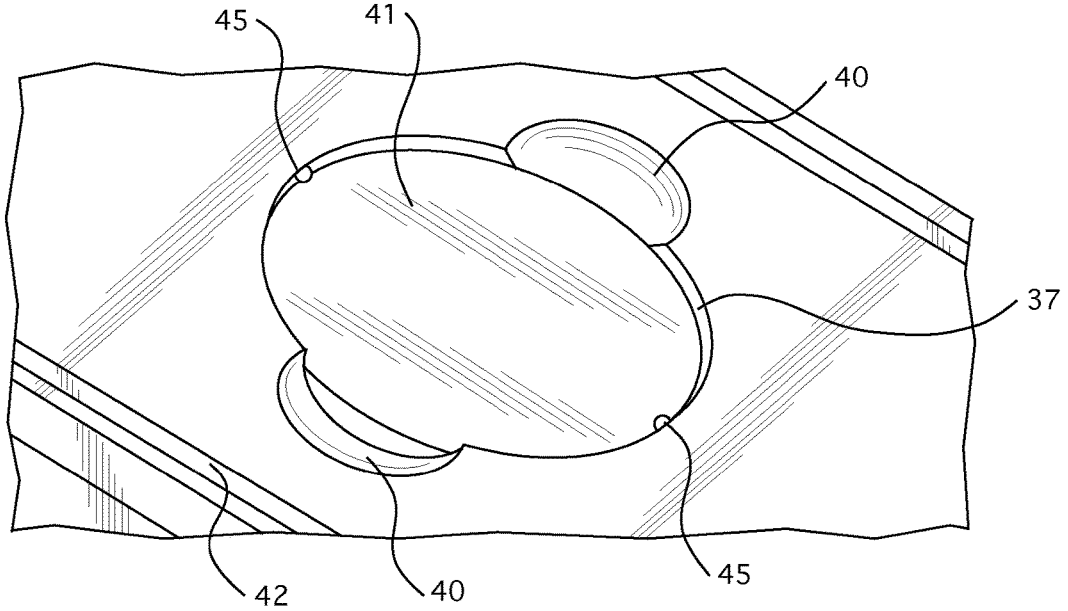
Figure 5:
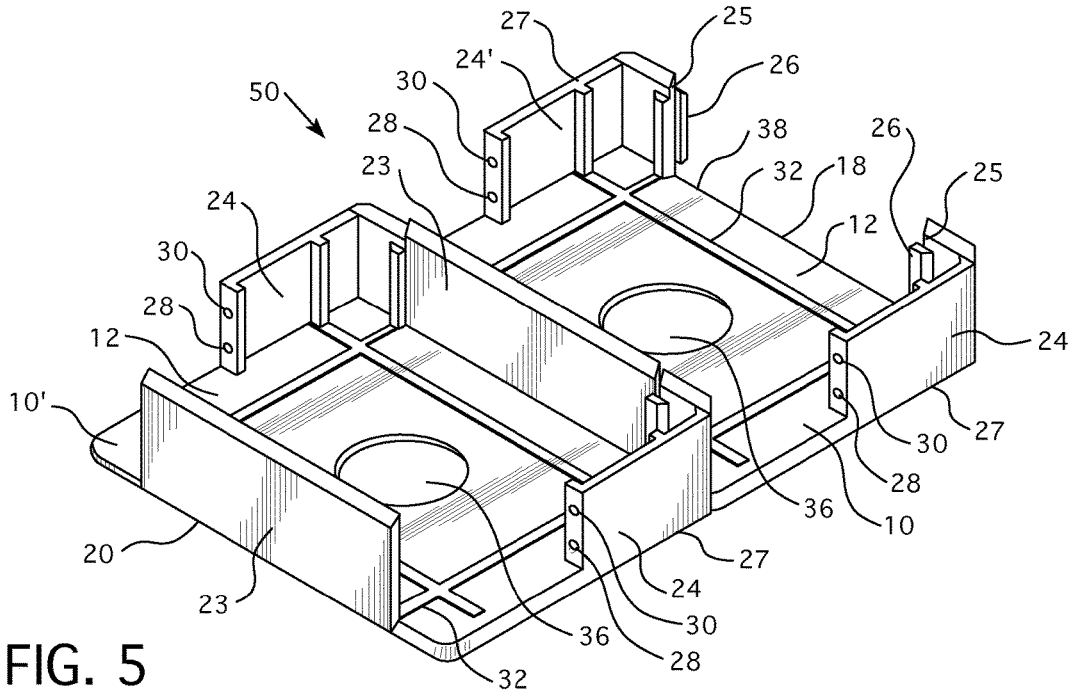
FIG. 5 is a perspective view of two card caddy units in an open configuration, in accordance with an embodiment of the present invention.

The different embodiments of the card caddy device of the present invention are shown generally in FIGS. 1-8. As shown in FIGS. 1 and 2, the card caddy device includes two or more card caddy units 10. The card caddy unit 10 includes a rectangular base 11. The rectangular base 11 has a bottom surface 12, a top surface 13, a first end 14, a second end 16, a first side 18, and a second side 20. The card caddy unit 10 has a first slot wall 24 and a second slot wall 24'. Each of the slot walls 24, 24' has an inner side 33 and an outer side 35. The slot walls 24, 24' are substantially perpendicular to the rectangular base 11. Each of the slot walls 24, 24' includes a short arm 25 and a long arm 27, which arms 25, 27 are substantially perpendicular to one another. The long arm 27 of the first slot wall 24 is located on the first end 14 of the bottom surface 12 of the rectangular base 11. The short arm 25 of the first slot wall 24 is located on the first side 18 of the bottom surface 12 of the rectangular base 11. The long arm 27 of the second slot wall 24' is located on the second end 16 of the bottom surface 12 of the rectangular base 11, and the short arm 25 of the second slot wall 24' is located on the first side 18 of the bottom surface 12 of the rectangular base 11. The ends of the short arms 25 of the slot walls 24, 24' have a space, or opening 38 there between (shown in FIG. 1A, 1B). Each of the slot walls 24, 24' has a slot 26 located on the end of the short arm 25. A bump 28 and a dimple 30, spaced apart from one another, are located on the end of each of the long arms 27 of the slot walls 24, 24' (shown in FIGS. 1B and 2C). The card caddy unit 10 includes a tab wall 23, the tab wall 23 having an inner side 29 and an outer side 31. The tab wall 23 is located centrally on the second side 20 of the bottom surface 12 of the rectangular base 11 and is substantially perpendicular to the rectangular base 11. Two small openings are formed between the ends of the tab wall 23 and the long arms 27 of the slot walls 24, 24'.

In addition, the card caddy unit 10 includes one or more longitudinal ribs 34 located on the inner sides 33 of the slot walls 24, 24' and the inner side 29 of the tab wall 23. The card caddy unit 10 also includes one or more elevated or raised grids 32 located on the bottom surface 12 of the rectangular base 11 running substantially parallel with the first side 18 and the second side 20 of the rectangular base 11; and one or more raised grids 32 located on the bottom surface 12 of the rectangular base 11 and running substantially parallel with the first end 14 and the second end 16 of the rectangular base 11. The ribs 34 on the sides of the card caddy unit 10 allow for secure placement of a deck of cards in the card caddy unit, and the elevated grids 32 allow a user to more easily pick up a last card in a stack of cards by providing leverage underneath the card.

The card caddy unit 10 also includes a circular opening 36 located centrally in the rectangular base 11. The circular opening 36 has an outer circumferential shoulder 37 continuous with the rectangular base 11 (shown in FIGS. 3, 4B and 7A-C) which is configured to hold a circular object 41 therein (shown in FIG. 4A, 4B), such as a coin or token for use in a card game, or to customize the look of a user's card caddy. The circular opening 36 also is configured so that a user can easily open a closed card caddy by inserting one finger into each of the circular openings in the closed card caddy and pulling their fingers gently apart so that the two card caddy units separate. The circumferential shoulder 37 has one or more bumps 45 on its periphery (shown in FIG. 4B), and one or more indentations 40 adjacent thereto. The one or more bumps 45 secure the circular object 41 on the circumferential shoulder 37, and the one or more indentations 40 allow for easy removal of the circular object 41 from the circular opening 36.

Figure 8A:
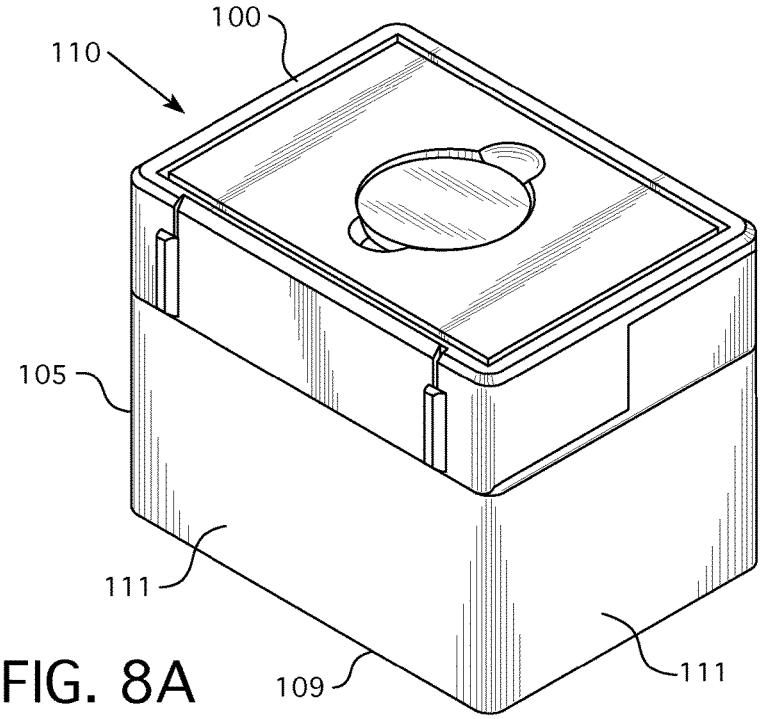
FIGS. 8A, 8B, 8C and 8D are perspective views of a closed card caddy with a storage box, in which 8A shows the closed card caddy affixed to the storage box; 8B shows the separated closed card caddy and the storage box; 8C is a partial view showing bumps located on the storage box; and 8D is a partial view showing dimples located on the card caddy unit for securing the closed card caddy to the storage box, in accordance with an embodiment of the present invention.
Figure 8B:
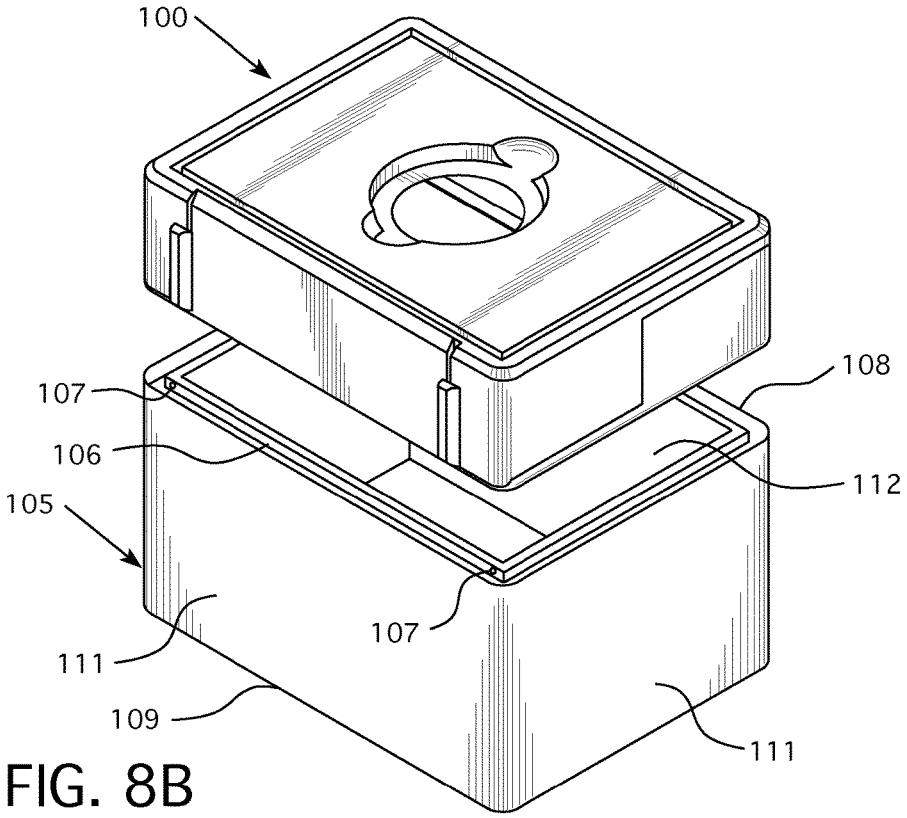
Figure 8C:
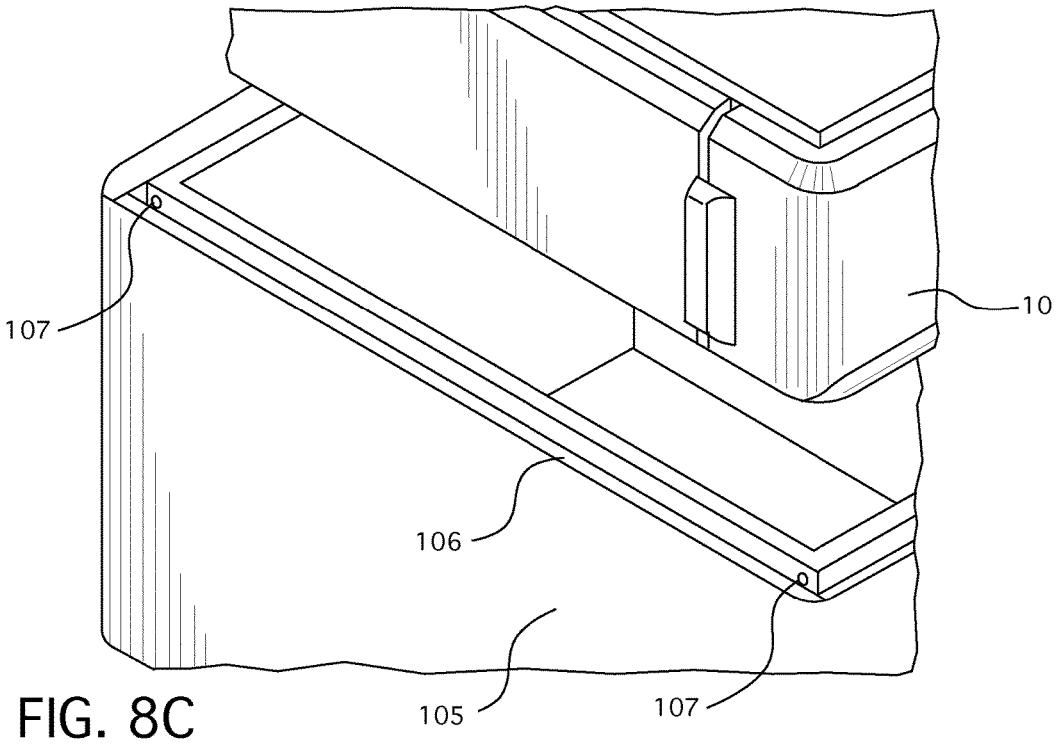
Figure 8D:
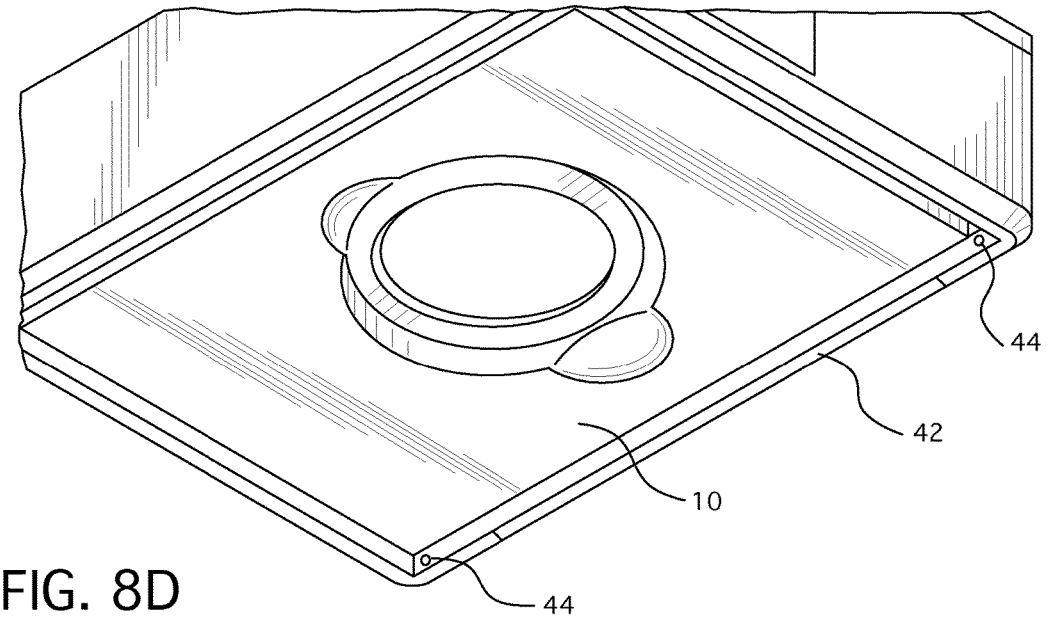

The card caddy unit 10 further includes a peripheral rectangular groove 42 located on the top surface 13, in which a groove dimple 44 is located at each of the four corners of the groove 42 (shown in FIG. 8D).

To configure two card caddy units into a closed card caddy 100 (shown in FIGS. 3 and 4A), two card caddy units are aligned together as follows: the first card caddy unit 10 fits into the second card caddy unit 10' by aligning the bottom end 12 of the first card caddy unit 10 atop the bottom end 12 of the second card caddy unit 10', and fitting the tab wall 23 of the first card caddy unit 10 into the slots 26 of the second card caddy unit 10' and the tab wall 23 of the second card caddy unit 10' into the slots 26 of the first card caddy unit 10. The closed card caddy 100 is closed securely by having the bump 28 and dimple 30 of the first card caddy unit 10 snap into the dimple 30 and the bump 28 of the second card caddy unit 10', respectively.

To configure two card caddy units into an open card caddy discard tray 50 (shown in FIG. 5), the two card caddy units are aligned together as follows: the first card caddy unit 10 fits into the second card caddy unit 10' by aligning the second side 20 of the first card caddy unit 10 next to the first side 18 of the second card caddy unit 10', and fitting the tab wall 23 of the first card caddy unit 10 into the slots 26 of the second card caddy unit 10'.

Figure 6:
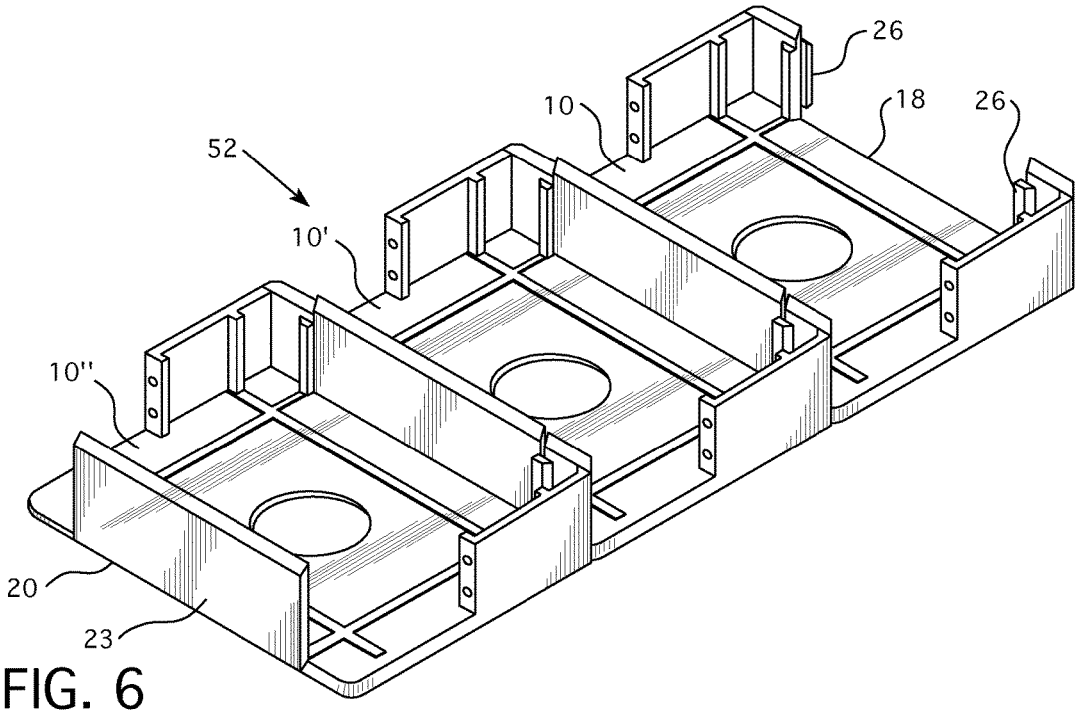
FIG. 6 is perspective view of three card caddy units in an open configuration, in accordance with an embodiment of the present invention.

The invention encompasses an open card caddy configuration having multiple discard trays, which are fitted together in the same way that the first two card caddy units are fitted together. For example, FIG. 6 shows an open card caddy 52 with two discard trays, in which a third card caddy unit 10" is aligned next to the second card caddy unit 10', and the tab wall 23 of the second card caddy unit 10' fits into the slots 26 of the third card caddy unit 10".

The card caddy device of the present invention may be manufactured from any suitable material, such as plastic.

The card caddy unit has a length (measured from the first end to the second end) ranging from about 2.0 inches to about 8.0 inches; and a width (measured from the first side to the second side) ranging from about 1.0 inch to about 5.0 inches. In an embodiment, the card caddy unit has a length of about 4.0 inches and a width of about 3.0 inches.

The thickness of the rectangular base, the tab wall, and the two slot walls of the card caddy unit are substantially identical, ranging from about 0.02 to about 0.2 inches. In an embodiment, the thickness of the rectangular base, the tab wall and the two slot walls is about 0.1 inch.

The tab wall has a length ranging from about 1.0 inch to about 4 inches; and a height of about 0.5 inches to about 6.0 inches. In an embodiment, the tab wall has a length of about 2.75 inches and a height of about 1.0 inch.

The long arm of the slot wall has a length ranging from about 0.75 inches to about 3.0 inches; and a height of about 0.5 inches to about 6.0 inches. In an embodiment, the length of the long arm of the slot wall is 1.5 inches and the height is about 1.0 inch.

The short arm of the slot wall has a length ranging from about 0.25 inches to about 1.5 inches; and a height of about 0.5 inches to about 6.0 inches. In an embodiment, the length of the short arm of the slot wall is about 0.65 inches and the height is about 1.0 inch.

It should be noted that the heights of the tab wall and the slot walls of two card caddy units comprising a particular card caddy device always are identical, which thus determines the overall height of the particular card caddy device.

When in a closed configuration, with two identical card caddy units fitting into one another as described in detail above, the card caddy has the same length and width of a single card caddy unit. The height of the card caddy is substantially the same as the height of the tab wall and slot walls of the card caddy unit, as the thickness added to the total height of the card caddy from the additional one rectangular base of one card caddy units ranges only from about 0.02 inches to about 0.2 inches.

The circular opening has a diameter ranging from about 0.25 inches to about 2.0 inches. In an embodiment, the diameter of the circular opening is about 1.0 inch. The circumferential shoulder bordering the circular opening has a width ranging from about 0.1 inch to about 0.75 inches. In an embodiment, the length of the circumferential shoulder is about 0.3 inches.

The discard opening in the card caddy unit has a length (measuring from the end of the first slot wall to the end of the second slot wall) ranging from about 1.0 inch to about 4.0 inches. In an embodiment, the length of the discard opening is about 2.7 inches.

The ribs of the card caddy unit have a height ranging from about 0.25 inches to about 4.0 inches. In an embodiment, the height of the ribs is about 0.75 inches.

The raised grids of the card caddy unit each has a height ranging from about 0.005 inches to about 0.1 inches; and a width ranging from about 0.02 to about 0.2 inches. In an embodiment, the height of the raised grids is about 0.02 inches and the width is about 0.1 inches. The raised grids which are substantially parallel to the first side and the second side of the card caddy unit have a length ranging from about 1.5 inches to about 5.0 inches. In an embodiment, the length of the raised grids substantially parallel to the sides of the card caddy unit is about 3.5 inches. The raised grids which are substantially parallel to the first end and the second end of the card caddy unit have a length ranging from about 1.5 inches to about 4.0 inches. In an embodiment, the length of the raised grids substantially parallel to the ends of the card caddy unit is about 2.7 inches.

Figure 7A:
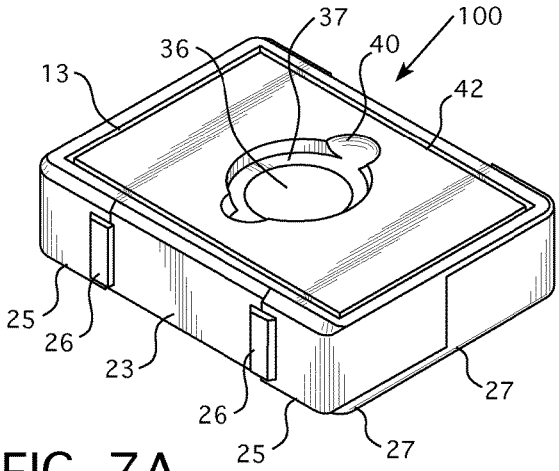
FIG. 7A, 7B and 7C are perspective views of three card caddies having different heights, in which 7B is a card caddy having a height about twice as high as 7A, and 7C has a height about three times as high as 7A, in accordance with an embodiment of the present invention.
Figure 7B:
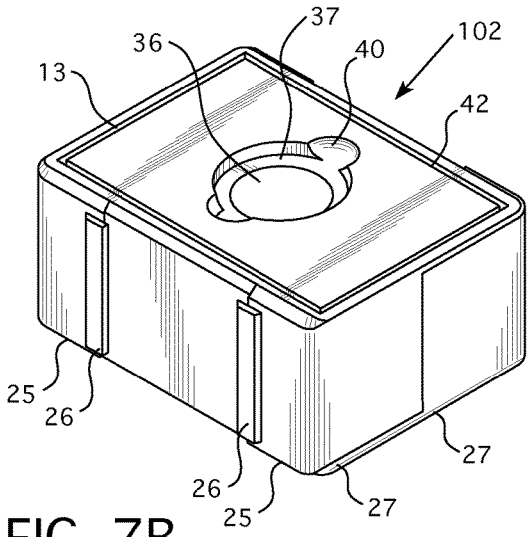
Figure 7C:
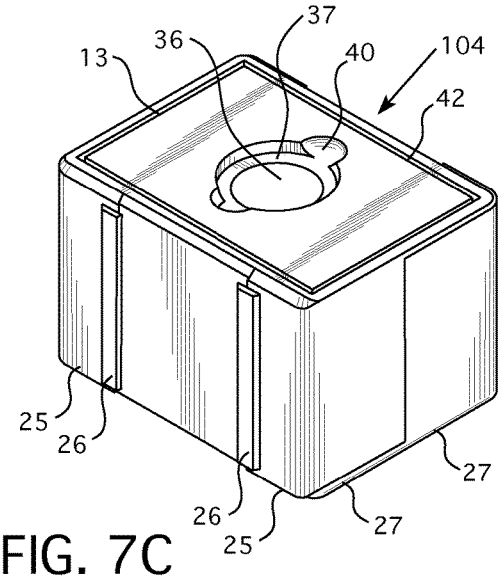

The present invention encompasses card caddy units having varying heights. In one embodiment, as shown in FIG. 7B, the heights of the tab wall and the slot walls of the card caddy unit may be two times the height of the "single decker" card caddy unit described above and shown in FIG. 7A, thus providing a "double-decker" card caddy. In another embodiment, as shown in FIG. 7C, the heights of the tab wall and the slot walls of the card caddy unit may be three times the height of the single-decker card caddy unit shown in FIG. 7A, thus providing a "triple-decker" card caddy. Configuration of card caddy units in the closed configuration having varying heights thus provides for the accommodation of additional cards or multiple decks of cards. The single-decker card caddy is scaled essentially to accept a standard fifty-two deck of cards. Double, triple and even quadruple versions of the card caddy are configured to accommodate the storage and play of multiple decks of cards. The invention also encompasses card caddy units with varying lengths and widths, to accommodate small or larger playing cards, such as collectible trading cards, tarot cards and the like.

The present invention also includes a way to store card game accessories with the card caddy device by providing a storage box that is configured to attach securely to a closed card caddy. As shown in FIG. 8A-8D, the invention includes a rectangular container 105 having a base 109 and four walls 111 projecting upwardly from and perpendicular to the base 109. The walls 111 define an interior opening 112 therein. The walls 111 at their open end 108 have a flange 106 thereon, wherein a container bump 107 is located at each of four corners of the flange 106 (best seen in FIG. 8C). The container 105 is configured to snap onto the closed card caddy 100 by placing the rectangular flange 106 of the container 105 into the rectangular groove 42 of the closed card caddy 100, in which the dimples 44 of the card caddy 100 snap into the bumps 107 of the flange106 in order to tightly secure the card caddy 100 onto the container 105.

The present invention contemplates that the rectangular storage container which snaps into the card caddy has a length and a width essentially the same as the card caddy to which it attaches, i.e., a length ranging from about 2.0 inches to about 8.0 inches; and a width ranging from about 1.0 inch to about 5.0 inches. In an embodiment, the rectangular storage container has a length of about 4.0 inches and a width of about 3.0 inches. The present invention encompasses a varying height of the rectangular storage container. In an embodiment, the height of the storage container ranges from about 1.5 inches to about 5.0 inches. In another embodiment, the height of the storage container is about 2.5 inches.

It is clear from the foregoing description that the card caddy device of the present invention possesses many advantageous features which make it superior to conventional card caddy boxes and discard trays. For example, each identical card caddy unit allows for cost-effective manufacturing, as only one mold is required for manufacture; the bump and dimple closing mechanism provides for secure closure of the card caddy when in the closed configuration while allowing for easy opening with minimal effort; the side opening of the discard tray allows a card to be discarded perpendicularly to the discard tray, allowing for discard history of a card game to be viewed during the card games which require this feature; the circular opening allows for viewing the deck of cards inside the closed card caddy, as well as providing assistance in opening the closed card caddy; and the slightly raised grid pattern on the bottom end of the rectangular base allows easier pick up of the last card in a stack of cards by providing leverage underneath the last card.

It will be appreciated by those skilled in the art that changes could be made to the embodiments described above without departing from the broad inventive concept thereof. It is understood, therefore, that this invention is not limited to the particular embodiments disclosed, but it is intended to cover modifications that are within the spirit and scope of the invention, as defined by the appended claims.

What is claimed is:

1. A card caddy device, comprising:

a plurality of identical card caddy units, each card caddy unit comprising:

a rectangular base having an inner surface, an outer surface, a first end, a second end, a first side, and a second side;

a first slot wall and a second slot wall, each of the slot walls having an inner side and an outer side, each of the slot walls comprised of a short arm and a long arm which are perpendicular to each other, the slot walls being perpendicular to the rectangular base, the long arm of the first slot wall located on the first end of the rectangular base, the short arm of the first slot wall located on the first side of the rectangular base, the long arm of the second slot wall located on the second end of the rectangular base, and the short arm of the second slot wall located on the first side of the rectangular base, wherein ends of the short arms of the slot walls having a space there between defining an opening;

a slot located at the end of each of the short arms of the slot walls; and a tab wall having an inner side and an outer side, the tab wall located centrally on the second side of the rectangular base and perpendicular thereto;

wherein one of the plurality of card caddy units fits into another one of the plurality of card caddy units to form a closed card caddy by aligning an inner side of the card caddy unit atop an inner side of the other card caddy unit, and fitting the tab wall of each of the card caddy units into the slots of the other card caddy unit, and wherein the one card caddy unit fits into the other card caddy unit to form an open card caddy discard tray by aligning the second side of the one card caddy unit next to the first side of the other card caddy unit, and fitting the tab wall of the one card caddy unit into the slots of the other card caddy unit.

2. The card caddy device of claim 1, further comprising a bump and a dimple spaced apart and located vertically from one another on an end of each of the long arms of the slot walls.

3. The card caddy device of claim 2, wherein the closed card caddy is securely closed by having the bumps and dimples of the one card caddy unit snap into the dimples and bumps of the other card caddy unit, respectively.

4. The card caddy device of claim 1, further comprising one or more longitudinal ribs located on the inner sides of the slot walls and the inner side of the tab wall.

5. The card caddy device of claim 1, further comprising one or more elevated grids located on the inner surface of the rectangular base and running parallel with the first side and the second side, and one or more elevated grids located on the inner surface of the rectangular base and running parallel with the first end and the second end.

6. The card caddy device of claim 1, further comprising a circular opening located in the center of the rectangular base.

7. The card caddy device of claim 6, wherein the circular opening has one or more bumps located on periphery of the circular opening and one or more indentations adjacent to the opening, the circular opening having a peripheral shoulder and configured to receive a circular object therein, the one or more bumps securing the circular object in the opening and the one or more indentations allowing for easy removal of the circular object.

8. The card caddy device of claim 1, wherein the outer surface of the rectangular base has an outer rectangular groove thereon, wherein a dimple is located at each of four corners of the groove.

9. The card caddy device of claim 1, wherein one or more additional card caddy units are fit into the open card caddy discard tray to form an open card caddy with multiple discard trays.

10. The card caddy device of claim 1, further comprising a rectangle container having a base and four walls projecting upwardly from and perpendicular to the base, the walls defining an interior opening therein, the walls having at their upper end a flange thereon, wherein a bump is located at each of four corners of the flange, wherein the container is configured to snap onto one of the plurality of card caddy units by placing the flange of the container into a rectangle groove of the card caddy unit, and wherein dimples of the card caddy unit snap into the bumps of the flange in order to secure the card caddy unit onto the container.

* * * * *